US011846462B2

(12) United States Patent
Shi et al.

(10) Patent No.: US 11,846,462 B2
(45) Date of Patent: Dec. 19, 2023

(54) DOOR MOUNTED CHILLED COMPONENT WITH DIRECT COOLING

(71) Applicant: Electrolux Home Products, Inc., Charlotte, NC (US)

(72) Inventors: Zhuochen Shi, Clemson, SC (US); Marcelo C. Candeo, Piedmont, SC (US); Thomas McCollough, Anderson, SC (US)

(73) Assignee: Electrolux Home Products, Inc., Charlotte, NC (US)

( * ) Notice: Subject to any disclaimer, the term of this patent is extended or adjusted under 35 U.S.C. 154(b) by 192 days.

(21) Appl. No.: 17/207,364

(22) Filed: Mar. 19, 2021

(65) Prior Publication Data

US 2022/0299250 A1 Sep. 22, 2022

(51) Int. Cl.

| | |
|---|---|
| ***F25D 11/02*** | (2006.01) |
| ***F25B 39/02*** | (2006.01) |
| ***F25D 23/02*** | (2006.01) |

(52) U.S. Cl.
CPC ..... *F25D 11/02* (2013.01); *F25B 39/022* (2013.01); *F25D 23/028* (2013.01)

(58) Field of Classification Search
CPC ..... F25D 11/02; F25D 23/028; F25D 23/04; F25B 39/022
See application file for complete search history.

(56) References Cited

U.S. PATENT DOCUMENTS

| | | | |
|---|---|---|---|
| 6,945,068 | B2 | 9/2005 | Kim et al. |
| 6,964,177 | B2 | 11/2005 | Lee et al. |
| 7,040,111 | B2 | 5/2006 | Lee et al. |
| 7,076,967 | B2 | 7/2006 | Lee et al. |
| 7,222,498 | B2 | 5/2007 | Lee et al. |
| 7,228,703 | B2 | 6/2007 | Kim et al. |
| 7,240,510 | B2 | 7/2007 | Lee et al. |
| 7,240,512 | B2 | 7/2007 | Lee et al. |
| 7,272,949 | B2 | 9/2007 | Lee et al. |
| 7,392,665 | B2 | 7/2008 | Lee et al. |
| 7,434,417 | B2 | 10/2008 | Lee |
| 7,458,230 | B2 | 12/2008 | Lee et al. |

(Continued)

OTHER PUBLICATIONS

International Search Report for PCT/US2022/020749, dated Jul. 5, 2022, 2 pages.

*Primary Examiner* — Elizabeth J Martin
*Assistant Examiner* — Samba Gaye
(74) *Attorney, Agent, or Firm* — Pearne & Gordon LLP

(57) ABSTRACT

A refrigerator includes: a fresh food compartment with an interior wall, an opening, and a door movable between a closed position and an open position for accessing the fresh food compartment via the opening; a cold plate mounted in the interior wall with an evaporator in contact with the cold plate; a chilled component movably mounted on the door adjacent the cold plate, the chilled component includes a heat transfer plate on a side of the chilled component for thermal communication with the cold plate, and a biaser moves the chilled component into thermal communication with the cold plate when the door is closed. The chilled component may be: an ice maker, a liquid/drink cooler, a vegetable cooler, a meat cooler, and/or a wine cooler. The biaser may include the following for moving the chilled component: a spring, an inclined plane, a pulley and weights, and/or a hydraulic piston.

18 Claims, 3 Drawing Sheets

(56) References Cited

U.S. PATENT DOCUMENTS

| | | | |
|---|---|---|---|
| 7,493,777 | B2 | 2/2009 | Kim et al. |
| 7,631,513 | B2 | 12/2009 | Chung et al. |
| 7,654,105 | B2 | 2/2010 | Lee et al. |
| 7,703,298 | B2 | 4/2010 | Lee et al. |
| 7,818,975 | B2 | 10/2010 | Chung et al. |
| 7,908,882 | B2 | 3/2011 | Lee et al. |
| 7,942,017 | B2 | 5/2011 | Lee et al. |
| 8,042,353 | B2 | 10/2011 | Lee et al. |
| 7,921,668 | B2 | 12/2011 | Lee et al. |
| 8,151,597 | B2 | 4/2012 | Shin et al. |
| 8,234,880 | B2 | 8/2012 | Kim et al. |
| 8,281,610 | B2 | 10/2012 | Kim et al. |
| 8,302,423 | B2 | 11/2012 | Lee et al. |
| 8,302,424 | B2 | 11/2012 | Seo et al. |
| 8,359,878 | B2 | 1/2013 | Kim et al. |
| 8,375,739 | B2 | 2/2013 | Kim et al. |
| 8,397,533 | B2 | 3/2013 | Lee et al. |
| 8,418,496 | B2 | 4/2013 | Lee et al. |
| 8,418,497 | B2 | 4/2013 | Lee et al. |
| 8,429,927 | B2 | 4/2013 | Lee et al. |
| 8,434,322 | B2 | 5/2013 | Lee et al. |
| 8,438,869 | B2 | 5/2013 | Kim et al. |
| 8,438,872 | B2 | 5/2013 | Yun et al. |
| 8,567,210 | B2 | 10/2013 | Park et al. |
| 8,572,999 | B2 | 11/2013 | Kim et al. |
| 8,573,719 | B2 | 11/2013 | Lee et al. |
| 8,601,830 | B2 | 12/2013 | Lee et al. |
| 8,627,678 | B2 | 1/2014 | Choi |
| 8,640,471 | B2 | 2/2014 | Lee et al. |
| 8,667,809 | B2 | 3/2014 | Kim et al. |
| 8,671,711 | B2 | 3/2014 | Kim |
| 8,677,775 | B2 | 3/2014 | Kim et al. |
| 8,677,776 | B2 | 3/2014 | Kim et al. |
| 8,689,578 | B2 | 4/2014 | Lee et al. |
| 8,707,728 | B2 | 4/2014 | Lee et al. |
| 8,726,686 | B2 | 5/2014 | Yoon et al. |
| 8,769,981 | B2 | 7/2014 | Hong et al. |
| 8,800,316 | B2 | 8/2014 | Lee et al. |
| 8,925,340 | B2 | 1/2015 | Chung et al. |
| 8,966,931 | B2 | 3/2015 | Yang |
| 8,991,205 | B2 | 3/2015 | Lee et al. |
| 9,109,826 | B2 | 8/2015 | Lee et al. |
| 9,146,050 | B2 | 9/2015 | Jeong |
| 9,228,769 | B2 | 1/2016 | Kim et al. |
| 9,234,687 | B2 | 1/2016 | Lee |
| 9,291,386 | B2 | 3/2016 | Kim et al. |
| 9,335,087 | B2 | 5/2016 | Hwang et al. |
| 9,423,166 | B2 | 8/2016 | Kim et al. |
| 9,568,232 | B2 | 2/2017 | Kim et al. |
| 9,677,800 | B2 | 6/2017 | Kim et al. |
| 9,702,608 | B2 | 7/2017 | Oh et al. |
| 2009/0293501 | A1* | 12/2009 | Kulkarni ..... F25D 23/12 62/344 |
| 2010/0126185 | A1* | 5/2010 | Cho ..... F25C 5/22 62/344 |
| 2010/0242526 | A1* | 9/2010 | Junge ..... F25D 17/065 165/47 |
| 2012/0167611 | A1 | 7/2012 | Weirich |
| 2018/0128534 | A1 | 5/2018 | Mitchell |
| 2022/0065516 | A1* | 3/2022 | Stewart ..... F25C 1/20 |

* cited by examiner

DOOR MOUNTED CHILLED COMPONENT WITH DIRECT COOLING

FIELD OF THE INVENTION

The invention is a refrigerator with a door mounted chilled component, e.g., an ice maker, that is directly cooled via cooling device located in the wall of the refrigerator.

BACKGROUND OF THE INVENTION

Conventional refrigeration appliances, such as domestic refrigerators, typically have both a fresh food compartment and a freezer compartment or section. The fresh food compartment is where food items such as fruits, vegetables, and beverages are stored. The freezer compartment is where food items that are to be kept in a frozen condition are stored. The refrigerators are provided with refrigeration systems that maintains the fresh food compartment at temperatures above 0° C., such as between 0.25° C. and 4.5° C. and the freezer compartments at temperatures below 0° C., such as between 0° C. and −20° C.

The arrangements of the fresh food and freezer compartments with respect to one another in such refrigerators vary. For example, in some cases, the freezer compartment is located above the fresh food compartment and in other cases the freezer compartment is located below the fresh food compartment. Additionally, many modern refrigerators have their freezer compartments and fresh food compartments arranged in a side-by-side relationship. Whatever arrangement of the freezer compartment and the fresh food compartment is employed, typically, separate access doors are provided for the compartments so that either compartment can be accessed without exposing the other compartment to the ambient air.

In an effort to enhance the commercial desirability of refrigerators, there is continuing search for new features. The invention disclosed herein, a door mounted chilled component that is directly cooled, is such a feature.

SUMMARY OF THE INVENTION

A refrigerator includes: a fresh food (FF) compartment with an interior wall, an opening, and a door movable between a closed position and an open position for accessing the FF compartment via the opening; a cold plate mounted in the interior wall with an evaporator in contact with the cold plate; a chilled component movably mounted on the door adjacent the cold plate, the chilled component includes a heat transfer plate on a side of the chilled component for thermal communication with the cold plate, and a biaser moves the chilled component into thermal communication with the cold plate when the door is closed. The chilled component may be: an ice maker, a liquid/drink cooler, a vegetable cooler, a meat cooler, and/or a wine cooler. The biaser may include the following for moving the chilled component: a spring, an inclined plane, a pulley and weights, and/or a hydraulic piston.

DESCRIPTION OF THE DRAWINGS

For the purpose of illustrating the invention, there is shown in the drawings a form that is presently preferred; it being understood, however, that this invention is not limited to the precise arrangements and instrumentalities and scale shown.

DESCRIPTION OF THE INVENTION

Figure 1:
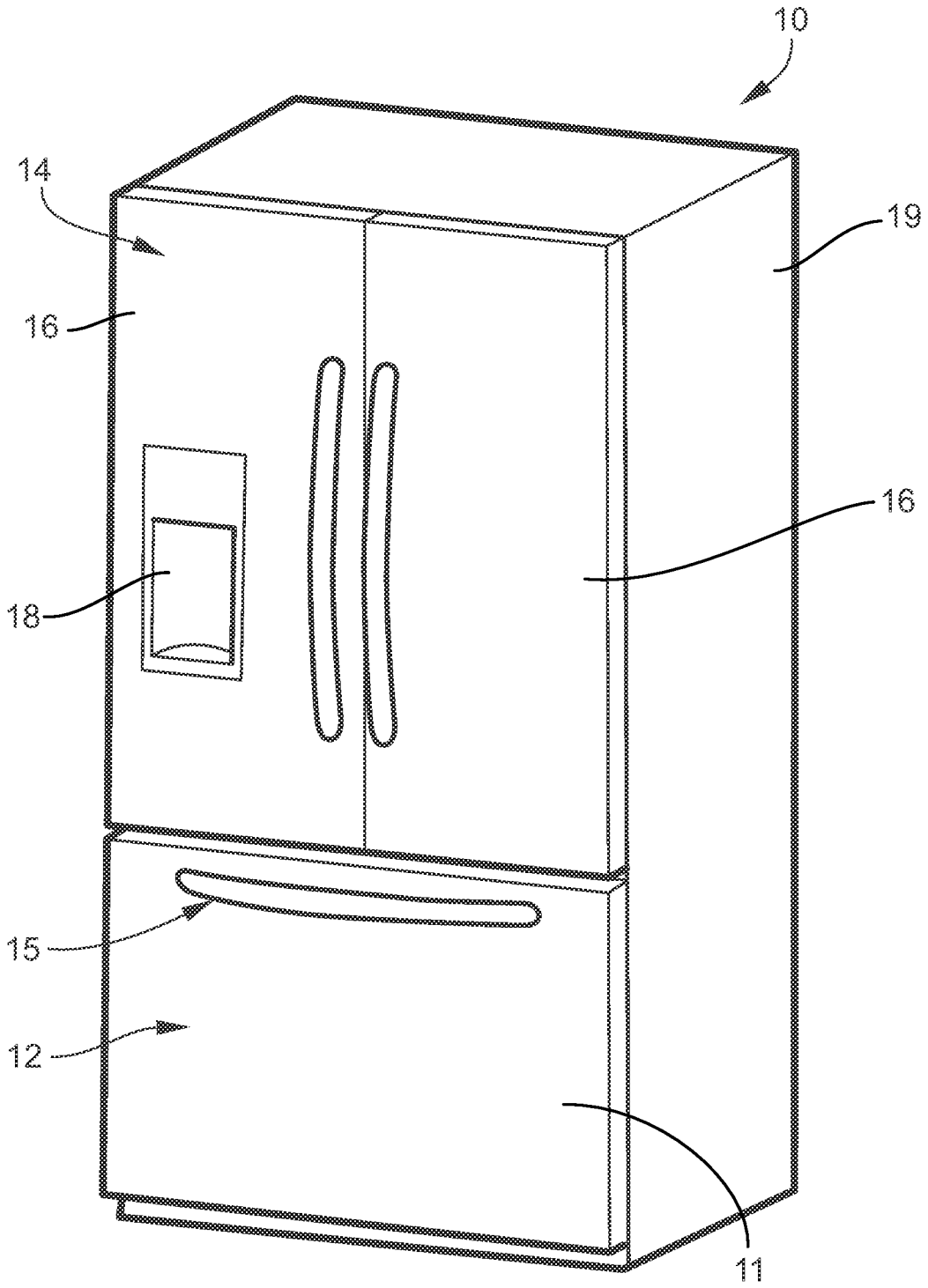
FIG. 1 is a front perspective view of a prior art household French door bottom mount refrigeration appliance showing doors of the fresh food compartment and drawer of a freezer compartment in a closed position.

Embodiments of a refrigerator or a component thereof now will be described with reference to the accompanying drawings. Whenever possible, the same reference numerals are used throughout the drawings to refer to the same or like parts.

Figure 2:
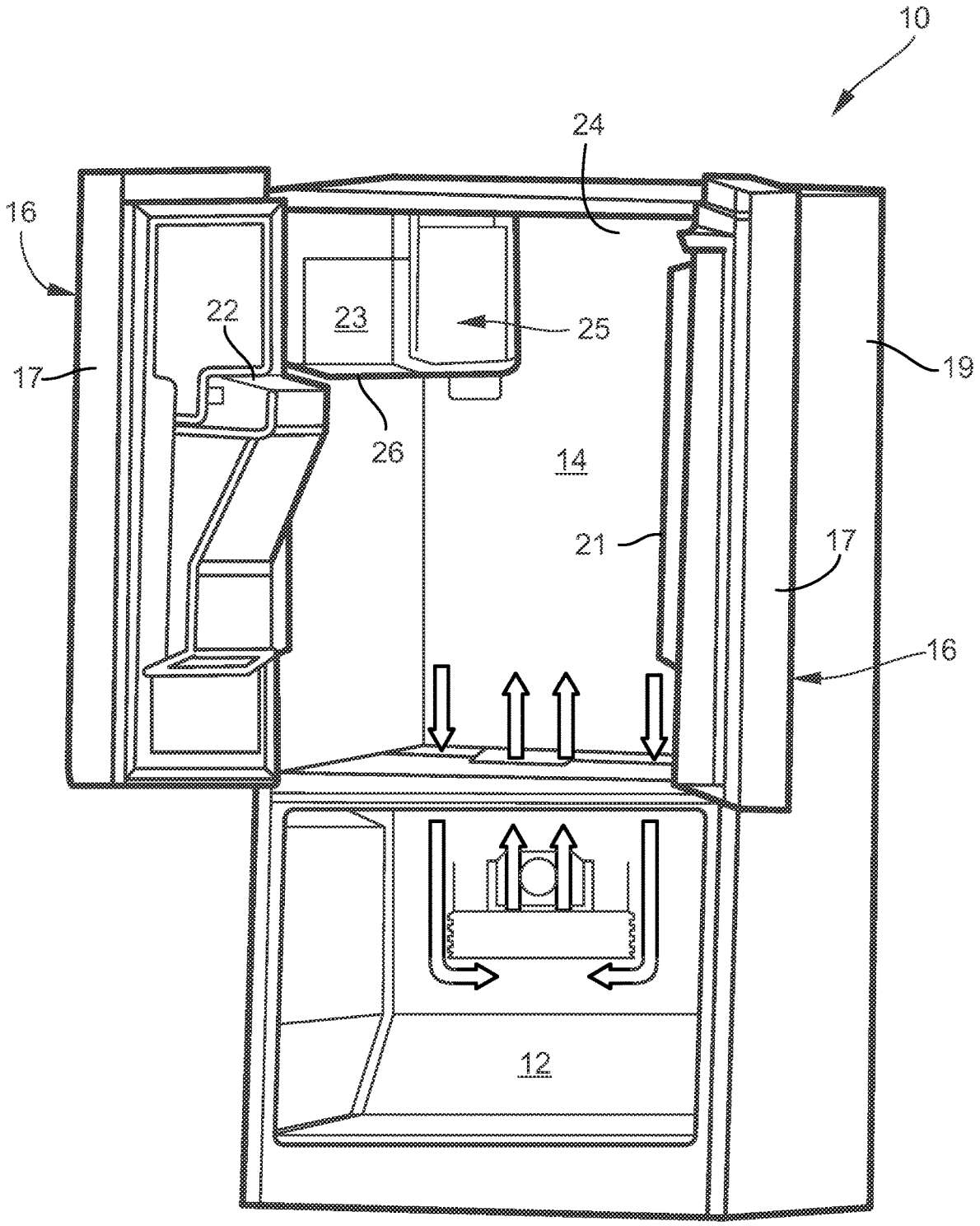
FIG. 2 is a front perspective view of the prior art refrigeration appliance of FIG. 1 showing the doors of the fresh food compartment in opened positions and the drawer of the freezer compartment removed.

Referring now to the drawings, FIGS. 1 and 2 show a refrigeration appliance in the form of a domestic refrigerator, indicated generally at 10. Although the detailed description that follows concerns a domestic refrigerator 10, the invention can be embodied by refrigeration appliances other than a domestic refrigerator 10. An embodiment is described in detail below, and shown in the figures as a bottom-mount configuration of a refrigerator 10, including a fresh food compartment 14 disposed vertically above a freezer compartment 12. However, the refrigerator 10 can have any desired configuration including at least a fresh food compartment 14 and/or a freezer compartment 12, such as a top mount refrigerator (freezer disposed above the fresh food compartment), a side-by-side refrigerator (fresh food compartment is laterally next to the freezer compartment), the freezer compartment is located below the fresh food compartment (i.e., a bottom mount refrigerator or French door refrigerator), a standalone refrigerator, or freezer, etc.

One or more doors 16 shown in FIG. 1 are pivotably coupled to a cabinet 19 of the refrigerator 10 to restrict and grant access to the fresh food compartment 14. The door 16 can include a single door that spans the entire lateral distance across the entrance to the fresh food compartment 14, or can include a pair of French-type doors 16 as shown in FIG. 1 that collectively span the entire lateral distance of the entrance to the fresh food compartment 14 to enclose the fresh food compartment 14.

For the latter configuration, a center flip mullion 21 (FIG. 2) is pivotally coupled to at least one of the doors 16 to establish a surface against which a seal provided to the other one of the doors 16 can seal the entrance to the fresh food compartment 14 at a location between opposing side surfaces 17 (FIG. 2) of the doors 16. The mullion 21 can be pivotably coupled to the door 16 to pivot between a first orientation that is substantially parallel to a planar surface of the door 16 when the door 16 is closed, and a different orientation when the door 16 is opened. The externally-exposed surface of the center mullion 21 is substantially parallel to the door 16 when the center mullion 21 is in the first orientation and forms an angle other than parallel relative to the door 16 when the center mullion 21 is in the second orientation. The seal and the externally-exposed surface of the mullion 21 cooperate approximately midway between the lateral sides of the fresh food compartment 14.

A dispenser 18 (FIG. 1) for dispensing at least ice pieces, and optionally water, can be provided on an exterior of one of the doors 16 that restricts access to the fresh food compartment 14. The dispenser 18 includes an actuator (e.g., lever, switch, proximity sensor, etc.) to cause frozen ice pieces to be dispensed from an ice bin 23 (FIG. 2) of an ice maker 25 disposed within the fresh food compartment 14. Ice pieces from the ice bin 23 can exit the ice bin 23 through an aperture 26 and be delivered to the dispenser 18 via an ice chute 22 (FIG. 2), which extends at least partially through the door 16 between the dispenser 18 and the ice bin 23.

The freezer compartment 12 is arranged vertically beneath the fresh food compartment 14. A drawer assembly (not shown) including one or more freezer baskets (not shown) can be withdrawn from the freezer compartment 12 to grant a user access to food items stored in the freezer compartment 12. The drawer assembly can be coupled to a freezer door 11 that includes a handle 15. When a user grasps the handle 15 and pulls the freezer door 11 open, at least one or more of the freezer baskets is caused to be at least partially withdrawn from the freezer compartment 12.

In alternative embodiments, the ice maker is located within the freezer compartment. In this configuration, although still disposed within the freezer compartment, at least the ice maker (and possible an ice bin) is mounted to an interior surface of the freezer door. It is contemplated that the ice mold and ice bin can be separate elements, in which one remains within the freezer compartment and the other is on the freezer door.

The freezer compartment 12 is used to freeze and/or maintain articles of food stored in the freezer compartment 12 in a frozen condition. For this purpose, the freezer compartment 12 is in thermal communication with a freezer evaporator (not shown) that removes thermal energy from the freezer compartment 12 to maintain the temperature therein at a temperature of 0° C. or less during operation of the refrigerator 10, preferably between 0° C. and −50° C., more preferably between 0° C. and −30° C. and even more preferably between 0° C. and −20° C.

The refrigerator 10 includes an interior liner 24 (FIG. 2) that defines the fresh food compartment 14. The fresh food compartment 14 is located in the upper portion of the refrigerator 10 in this example and serves to minimize spoiling of articles of food stored therein. The fresh food compartment 14 accomplishes this aim by maintaining the temperature in the fresh food compartment 14 at a cool temperature that is typically above 0° C., so as not to freeze the articles of food in the fresh food compartment 14. It is contemplated that the cool temperature preferably is between 0° C. and 10° C., more preferably between 0° C. and 5° C. and even more preferably between 0.25° C. and 4.5° C.

According to some embodiments, cool air from which thermal energy has been removed by the freezer evaporator can also be blown into the fresh food compartment 14 to maintain the temperature therein greater than 0° C. preferably between 0° C. and 10° C., more preferably between 0° C. and 5° C. and even more preferably between 0.25° C. and 4.5° C. For alternate embodiments, a separate fresh food evaporator can optionally be dedicated to separately maintaining the temperature within the fresh food compartment 14 independent of the freezer compartment 12.

According to an embodiment, the temperature in the fresh food compartment 14 can be maintained at a cool temperature within a close tolerance of a range between 0° C. and 4.5° C., including any subranges and any individual temperatures falling with that range. For example, other embodiments can optionally maintain the cool temperature within the fresh food compartment 14 within a reasonably close tolerance of a temperature between 0.25° C. and 4° C.

Figure 3:
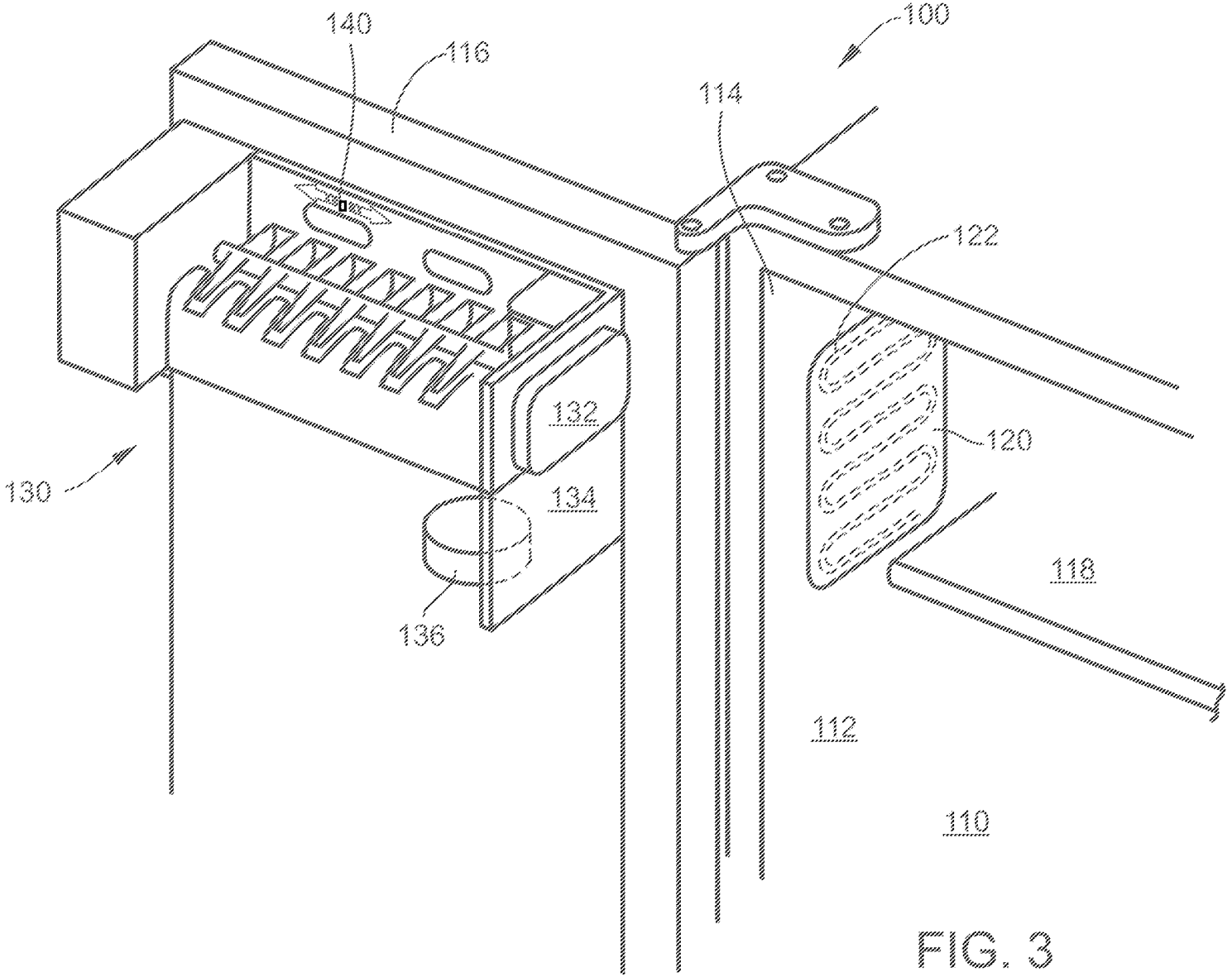
FIG. 3 is an isometric view of an embodiment of the invention.

Referring to FIG. 3, an embodiment of the refrigerator 100 is illustrated. in general, this embodiment of refrigerator 100 may include: a fresh food compartment 110 with an interior wall 112, an opening 114, and a door 116 movable between a dosed position and an open position for accessing the fresh food compartment via the opening; a cold plate 120 mounted in. the interior wall 112 with an evaporator 122 within the cold plate 120 a chilled component 130 movably mounted on the door 116 adjacent the cold plate 120, the chilled component 130 includes a heat transfer plate 132 on a side 134 of the chilled component 130 for thermal communication with the cold plate 120 and a biaser 140 moves the chilled component 130 into thermal communication with the cold plate 120 when the door 116 is closed. The elements of refrigerator 100 will be discussed in greater detail below.

Refrigerator 100 may be any commercially available refrigerator. Such refrigerators, as discussed above, include: a top mount refrigerator (freezer disposed above the fresh food compartment), a side-by-side refrigerator (e.g., fresh food compartment is laterally next to the freezer compartment), a bottom mount refrigerator (e.g., the freezer compartment is located below the fresh food compartment—e.g., a bottom mount refrigerator or French door refrigerator), a standalone refrigerator, or freezer, etc.

Fresh food (FF) compartment 110 is conventional, except as modified herein. The FF compartment 110 has interior walls 112. The interior wall may be a side wall, top wall, bottom wall, and back wall. The FF compartment 112 also has an opening 114 through which access to the content of the FF compartment 112 is gained. FF compartment 112 may include one or more shelves 118 or drawer (not shown). Door 116, as is conventional, moves between a closed position, where opening 114 is closed, and an open position, where opening 114 is open.

Cold plate 120 is mounted on an interior wall 112 and includes an evaporator 122. The evaporator 122 is where compressed refrigerant is expanded and consumes heat in expansion. The refrigerant may be supplied from within the refrigerator from existing compressor or from an additional compressor. The evaporator 122 is conventional. Evaporator 122 is in thermal communication with (or in contact with) the cold plate 120. The evaporator 122 and the cold plate may be discrete or separate elements. Evaporator 122 may be a coil evaporator or plate evaporator. Cold plate 120 has a face that is exposed to the interior of the FF compartment 110.

Chilled component 130 may be mounted on door 116. Mounting may include slidable mounting, e.g., laterally or horizontally mounted or vertically mounted. The chilled component may be device and/or a space (or volume or cavity or compartment). The chilled component may be: an ice maker (shown in FIG. 3—but not limiting), a liquid/drink cooler, a vegetable cooler, a meat cooler, and/or a wine cooler. Chilled component 130 may also include a heat transfer plate 132 of an exterior side 134 of chilled component 130. Heat transfer plate 132, when door 116 is in the closed position, is in thermal communication with cold plate 120 (i.e., the face of cold plate 120). Optionally, chilled component 130 may include a fan 136 for circulating cold/chilled air within the compartment.

Chilled component 130, in some embodiment, may be the ice maker (see FIG. 3). The ice maker may be conventional. In one embodiment, the ice maker may include: a metal ice cube mold tray rotatably mounted (e.g., rotatably mounted on a horizontal axis), a plurality of metal heat transfer ribs located below the metal ice cube mold tray and in thermal communication with the metal ice cube mold tray, and an ice cube bucket located below the metal ice cube mold tray.

Baiser 140 is operatively associated with the chilled component 130. Baiser 140 moves chilled component 130 into thermal communication with the cold plate 120 when door 116 is in the closed position, note arrows indication movement (of an embodiment). Baiser 140 may include any number of mechanisms including, but limited to: a spring for moving the chilled component into the cold plate, an inclined plane for moving the chilled component into the cold plate, a pulley and weights for moving the chilled component into the cold plate, and/or a hydraulic piston for moving the chilled component into the cold plate.

Optionally, the refrigerator 100 may include an evaporator controller (not shown). Evaporator controller controls when refrigerant is allowed to expand in the evaporator 122. Evaporator controller may be configured to only allow refrigerant in the evaporator 122 when heat transfer plate 132 is in thermal communication with cold plate 120.

In operation, when door 116 is in the closed position, chilled component 130 is in thermal communication, via heat transfer plate 132, with cold plate 120. In the closed position, heat is removed from the chilled component, in a known fashion. Chilled component 130 is moved into contact with the cold plate 120 by the action of the biaser 140. When the door 116 is in the open position, chilled component 130 is disengaged from cold plate 120, by action of the biaser 140. In the open position, the chilled component is accessible on the opened door 116.

The present invention may be embodied in other forms without departing from the spirit and the essential attributes thereof, and, accordingly, reference should be made to the appended claims, rather than to the foregoing specification, as indicating the scope of the invention.

We claim:

1. A refrigerator comprising:

a fresh food compartment with an interior wall, an opening, and a door movable between a closed position and an open position for accessing the fresh food compartment via the opening;

a cold plate mounted in the interior wall with an evaporator in contact with the cold plate;

a chilled component moveably mounted on the door adjacent the cold plate, the chilled component includes a heat transfer plate on a side of the chilled component for thermal communication with the cold plate, and a biaser moves the chilled component into thermal communication with the cold plate when the door is closed, wherein the biaser includes a spring for moving the chilled component into the cold plate.

2. The refrigerator of claim 1 wherein the chilled component is an ice maker.

3. The refrigerator of claim 1 wherein the evaporator is a coil evaporator or a plate evaporator.

4. The refrigerator of claim 1 wherein the chilled component includes a fan for circulating air within the chilled component.

5. The refrigerator of claim 1, wherein the chilled component is one of a liquid/drink cooler, vegetable cooler, meat cooler, or wine cooler.

6. The refrigerator of claim 1, wherein the biaser includes an inclined plane for moving the chilled component into the cold plate.

7. A refrigerator comprising:

a fresh food compartment with an interior wall, an opening, and a door movable between a closed position and an open position for accessing the fresh food compartment via the opening;

a cold plate mounted in the interior wall with an evaporator in contact with the cold plate;

a chilled component moveably mounted on the door adjacent the cold plate, the chilled component includes a heat transfer plate on a side of the chilled component for thermal communication with the cold plate, and a biaser moves the chilled component into thermal communication with the cold plate when the door is closed, wherein the biaser includes a pulley and weights for moving the chilled component into the cold plate.

8. The refrigerator of claim 7, wherein the chilled component is an ice maker.

9. The refrigerator of claim 7, wherein the evaporator is a coil evaporator or a plate evaporator.

10. The refrigerator of claim 7, wherein the chilled component includes a fan for circulating air within the chilled component.

11. The refrigerator of claim 7, wherein the chilled component is one of a liquid/drink cooler, vegetable cooler, meat cooler, or wine cooler.

12. The refrigerator of claim 7, wherein the biaser includes an inclined plane for moving the chilled component into the cold plate.

13. A refrigerator comprising:

a fresh food compartment with an interior wall, an opening, and a door movable between a closed position and an open position for accessing the fresh food compartment via the opening;

a cold plate mounted in the interior wall with an evaporator in contact with the cold plate;

a chilled component moveably mounted on the door adjacent the cold plate, the chilled component includes a heat transfer plate on a side of the chilled component for thermal communication with the cold plate, and a biaser moves the chilled component into thermal communication with the cold plate when the door is closed, wherein the biaser includes a hydraulic piston for moving the chilled component into the cold plate.

14. The refrigerator of claim 13, wherein the chilled component is an ice maker.

15. The refrigerator of claim 13, wherein the evaporator is a coil evaporator or a plate evaporator.

16. The refrigerator of claim 13, wherein the chilled component includes a fan for circulating air within the chilled component.

17. The refrigerator of claim 13, wherein the chilled component is one of a liquid/drink cooler, vegetable cooler, meat cooler, or wine cooler.

18. The refrigerator of claim 13, wherein the biaser includes an inclined plane for moving the chilled component into the cold plate.

* * * * *